US005514472A

United States Patent [19]

Baris et al.

[11] Patent Number: 5,514,472

[45] Date of Patent: May 7, 1996

[54] SOIL-REPELLENT MONOFILAMENT FOR PAPER MACHINE WIRE-CLOTHS, PRODUCTION THEREOF AND USE THEREOF

[75] Inventors: Halim Baris, Luzern; Erwin Lerch, Emmenbrücke, both of Switzerland

[73] Assignee: Rhone-Poulenc Viscosuisse S.A., Emmenbruecke, Switzerland

[21] Appl. No.: 513,530

[22] Filed: Aug. 10, 1995

Related U.S. Application Data

[63] Continuation of Ser. No. 240,664, Apr. 29, 1994, Pat. No. 5,472,780.

[30] Foreign Application Priority Data

Sep. 1, 1992 [CH] Switzerland ..... 2734/92

[51] Int. Cl.[6] ..... D02G 3/00

[52] U.S. Cl. ..... 428/365; 428/395; 525/165; 525/177; 139/425 A; 162/903

[58] Field of Search ..... 428/365, 395; 525/177, 165; 139/425 A; 162/903

[56] References Cited

U.S. PATENT DOCUMENTS

| | | | |
|---|---|---|---|
| 3,562,200 | 2/1971 | Jones | 525/177 |
| 3,723,373 | 3/1973 | Lucas | 525/165 |
| 4,002,581 | 1/1977 | Dolce | 525/177 |
| 4,822,454 | 4/1989 | Meirowitz et al. | 162/199 |
| 5,283,110 | 2/1994 | Gardner et al. | 525/165 |

FOREIGN PATENT DOCUMENTS

| | | |
|---|---|---|
| 0506983 | 7/1992 | European Pat. Off. . |
| 3301270 | 7/1984 | Germany . |
| 62-28822 | 10/1987 | Japan . |

*Primary Examiner*—Newton O. Edwards
*Attorney, Agent, or Firm*—Michael J. Striker

[57] ABSTRACT

The dirt-repellent monofilament with a toughness of at least 36 cN/tex and an extension of under 44% has a soiling index A1>2 after five soiling and cleaning cycles. To manufacture the dirt-repellent monofilaments, a copolymer with a melting point of 255° to 275° C. and consisting of alkenes and perfluoroalkenes is added to a polymer melt of polythylene terephthalate before extrusion. The dirt-repellent monofilament is advantageously used in the manufacture of cleaning filters for the dry section of a paper machine, i.e. paper machine fabric filters. It may also be used to produce fabrics for general use as technical fabrics which have to be cleaned in difficult conditions.

1 Claim, 1 Drawing Sheet

SOIL-REPELLENT MONOFILAMENT FOR PAPER MACHINE WIRE-CLOTHS, PRODUCTION THEREOF AND USE THEREOF

This is a continuation of application Ser. No. 08/240,664 filed Apr. 29, 1994, now U.S. Pat. No. 5,472,780.

The invention relates to a wire-cloth for a paper machine with soil-repellent monofilaments, having a diameter from 0.2 to 0.7 man, of at least 85% by weight of polyethylene terephthalate having a viscosity index (V.I.) of at least 96 dl/g and a copolymer, processes for production, and its use.

By "soil-repellent" properties for paper machine wire-cloths are meant the wet soiling, which also predicates hydrolysis resistance. The soil repellency is intended to lengthen the cleaning cycles of a wire-cloth, the cleaning work being done under a high-pressure water jet and if necessary under friction with a brush. Soil-repellent monofilaments which should also be hydrolysis-resistant at the same time are woven into industrial cloths and used in particular in the dryer part of a paper machine. Such drying wire-cloths are exposed to temperatures far above 100° C. and moisture and, during cleaning, also to increased mechanical stress. Soil-repellent polyester monofils have failed because of their ease of hydrolysis. The addition of additives in the form of stabilizers brought about a further improvement in the hydrolysis resistance, but it is still not sufficient for paper machine wire-cloths of the dryer part. Apart from adding additives, other attempts to enhance the soil-repellent properties include using suitable spin finishes, finishing treatments on the filament, and aftertreatment on the cloth.

Similarly, monofilaments were produced from the copolymer ethylenetetrafluoroethylene, whose thermal and chemical resistance are excellent and are therefore used in chemical process technology. Paper machine dryer wire-cloths are known which carry such monofilaments at the cloth surface and which protect the polyester monofilament base fabric underneath from soiling. However, the excellent chemical properties of the fluoropolymers are coupled with their inadequate tensile strength and elongation properties. Moreover, the production and disposal of a fluoropolymer having a fluorine content of about 50% is very costly compared with a polyester.

Attempts have already been made to combine the mechanical properties of a mechanically stable filament with the desirable chemical properties of a fluoropolymer by sheathing the mechanically stable filament by coextrusion with a fluorine-containing polymer (DE-A-3301270). The sheath was kept as thin as possible for economic reasons. However, the known core-sheath threads are not suitable for use as paper machine wire-cloths with repeated use and cleaning under the rough conditions in the operation of a paper mill.

SUMMARY OF THE INVENTION

The object of the invention is to provide a wire-cloth for a paper machine with soil-repellent monofilaments which meets the high requirements of an industrial cloth in respect of its chemical, soil-repellent, mechanical and abrasion-resistant properties and finds use in particular in the dryer part of a paper machine wire-cloth.

In keeping with these features and with others which will become apparent hereinafter, one feature of the present invention resides, briefly stated, in a wire-cloth for paper machine comprising a plurality of soil-repellent monofilaments containing at least 85% by weight of polyethylene terephthalate having a viscosity index of at least 96 dl/g and 1.5 to 5% by weight of a polynary copolymer prepared from ethene and tetrafluoroethene, wherein the soil-repellent monofilament has a diameter from 0.2 to 0.7 mm and a soiling index <2 after five soiling and washing cycles.

When the wire-cloth is produced in accordance with the present invention, it provides the above mentioned highly advantageous results.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
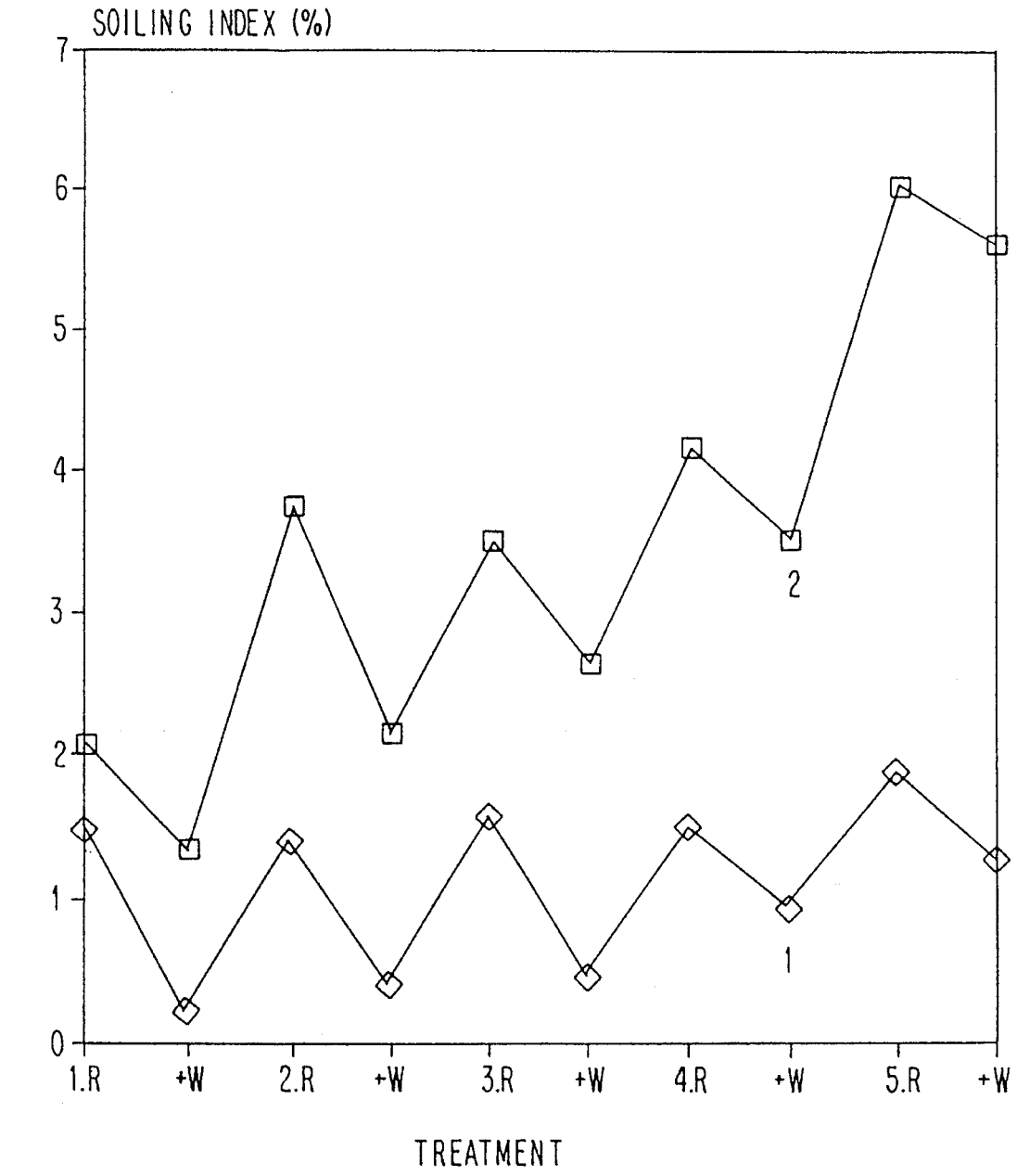
FIG. 1 is a view showing a diagram of soiling index of a soil-repellent monofilament in accordance with the present invention.

A wire-cloth for paper machine in accordance with the present invention has a plurality of soil-repellent monofilaments containing at least 85% weight of polyethylene terephthalate having a viscosity index of at least 96 dl/g and 1.5 to 5% by weight of a polynary copolymer prepared from ethene and tetrafluoroethene. The soil-repellent monofilaments have a diameter from 0.2 to 0.7 mm and a soiling index <2 after five soiling and washing cycles.

It is advantageous to use a polyester consisting of at least 85% by weight of polyethylene terephthalate. It may be pointed out as a particular advantage that the produced monofilament has a homogeneous composition over the entire cross-section. The melt may if necessary also have mixed into it from 1 to 3% of color pigments.

A suitable polyethylene terephthalate has a viscosity index >96.

A suitable copolymer consists of about 50% by weight of ethene and about 50% by weight of tetrafluoroethene. The copolymer can be added to the melt in the form of a master batch consisting of about 50% by weight polyethylene terephthalate and about 50% by weight of copolymer.

Particularly suitable soil-repellent monofilaments are those having a diameter from 0.2 to 0.7 mm and consisting of a polyblend of polyethylene terephthalate having at least 85% by weight of polyethylene terephthalate units and from 1.5 to 5% by weight, in particular from 1.5 to 3.0% by weight, of a polynary copolymer prepared from alkenes and perfluoroalkenes.

Suitable polynary copolymers are in particular binary systems. These are simple to obtain by copolymerizing the individual components. Copolymers of ethene and tetrafluoroethene are advantageous on account of their ready availabilty, and a melting point within the range between 255° C. and 275° C. is particularly advantageous. Other binary or polynary fluoroplastics such as hexafluoropropylene-modified polytetrafluoroethylenes, polyvinylidene fluorides and the like can be used.

It is particularly advantageous for the monofilament to contain from 1.5 to 5% by weight of the copolymers with polyfluoroalkylene units, preferably from 1.5 to 3% by weight, in particular from 2 to 3% by weight.

The tenacity of the monofilaments is higher than 36 cN/tex, in particular from 36 to 60 cN/tex, coupled with an elongation of <44%, based on the unextended filament, and as the essential feature it is particularly surprising for the soil repellency to be so good. The soil repellency has been determined as a soiling index with <2 after 5 soiling/washing cycles, compared with >5 in the case of a polyester filament without copolymers.

The use of the novel soil-repellent monofilaments having a diameter from 0.2 to 0.7 mm is particularly suitable for producing paper machine wire-cloths.

The invention will now be more particularly described with reference to an operative example and a comparative example.

Comparative Example Without Copolymers

Hydrolysis-stabilized high-viscosity (VI 96) polyethylene terephthalate is melt-extruded in known manner at a temperature of 290° C. through a spinneret having an orifice diameter of 1.8 mm at a throughput of 486 g/min. The extruded monofilaments are cooled down in a waterbath at 70° C. After the cooling-off, the monofilaments are spin-finished, drawn to a draw ratio of in total 5.25x, relaxed and wound up at a speed of 100 m/min. The resulting thread, having a linear density of 2700 dtex, which corresponds to a diameter of 0.50 mm, has after a 5-fold treatment a soiling index of more than 5, has a tenacity (Ft) of 38 cN/tex coupled with an elongation (Dt) of 40% and a thermal shrinkage (TS at 160° C.) of 0.4%, based on the unshrunk thread.

Operative Example

To prepare the mixture (master batch), a compounder is used to process 50% by weight of polyethylene terephthalate (I) together with a copolymer (II) prepared from 50% by weight of ethylene and 50% by weight of tetrafluoroethylene.

High-viscosity (VI 96) polyethylene terephthalate (polyester) is melted at a temperature of 290° C. To the melt is added 4% by weight of the mixture (master batch), corresponding to 2% by weight of copolymer (II), by means of a metering device. Extrusion takes place via a spinneret having an orifice diameter of 1.8 mm, likewise at a throughput of 486 g/min. The extruded monofilaments are cooled down in the same way in a waterbath at 70° C. After the cooling-off, the monofilaments are spin-finished, drawn to a draw ratio of in total 5.25x, relaxed and wound up at a speed of 100 m/min. The resulting thread, having a diameter of 0.50 mm, has after a 5-fold treatment a soiling index of less than 2 (<2), has a tenacity (Ft) of 37 cN/tex coupled with an elongation (Dt) of 39% and a thermal shrinkage (TS at 160° C.) of 0.4%, based on the unshrunk thread.

To determine the soil-repellent effect of monofilaments for paper machine wire-cloths, the following method was developed:

Principle of Test Method

Stainless steel platelets are precision-wound with three layers of the monofil. Following wash-off of the spin finish and colorimetric evaluation (DATACOLOR Texflash type 3881), the upper surface of the monofil card is soiled eight times in a defined way by "transfer printing" from a wet newspaper in a hot press at 130° C. Colorimetric evaluation is followed by specified washing, drying and colorimetric remeasurement. This soiling/washing process is carried out in total five times in succession to determine the soil-release properties at the same time. The result is quantified at each stage in terms of the DL* (D65) values, which are each based on the cards before the first soiling as reference. DL* (D65) corresponds to the lightness difference of the sample from the reference under daylight. To exclude influences due to the color differences of samples, the effect is reported as the percentage lightness decrease, which is defined as $$AI=[DL^*]/L^*_0\times 100$$

and is called the soiling index. $L^*_0$ is the lightness of the reference.

Soiling properties:

The AI or the soiling values depicted in FIG. 1 show the influence of the successive cycles of "soiling" R/"washing"+W. Each point represents AI averages of two cards after soiling and after washing. Curve 1 shows the monofilament thread of the invention. Curve 2 shows a comparative thread of polyester according to the state of the art, i.e. without (II). After (five) 5 soiling/washing cycles the monofilament of the invention achieves indices below 2.

The monofil thread of the invention represents an improvement over the state of the art by a factor of from 4 to 5. It is preferably suitable for use in paper machine wire-cloths.

It will be understood that each of the elements described above, or two or more together, may also find a useful application in other types of constructions differing from the types described above.

While the invention has been illustrated and described as embodied in a wire-cloth for paper machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. Wire-cloth for paper machine comprising a plurality of soil-repellent monofilaments containing at least 85% by weight of polyethylene terephthalate having a viscosity index of at least 96 dl/g and 1.5 to 5% by weight of a polynary copolymer prepared from ethene and tetrafluoroethene;

wherein said soil-repellent monofilament has a diameter from 0.2 to 0.7 mm and a soiling index <2 after five soiling and washing cycles.

* * * * *